United States Patent [19]

Zeindler et al.

[11] 4,288,859

[45] Sep. 8, 1981

[54] APPARATUS FOR PLACING IN ORDER THE SERVICING SEQUENCE OF STOREY CALLS OF ELEVATOR SYSTEMS

[75] Inventors: Stephan Zeindler, Gunzwil; Hans G. Süss, Udligenswil, both of Switzerland

[73] Assignee: Inventio AG, Hergiswil, Switzerland

[21] Appl. No.: 957,335

[22] Filed: Nov. 2, 1978

[30] Foreign Application Priority Data

Nov. 8, 1977 [CH] Switzerland ..... 13564/77

[51] Int. Cl.[3] ..... B66B 1/18

[52] U.S. Cl. ..... 364/900; 187/29 R; 340/20

[58] Field of Search ..... 340/19 R, 20, 21; 187/29 R, 29 SE; 364/200 MS File, 900 MS File

[56] References Cited

U.S. PATENT DOCUMENTS

| | | | |
|---|---|---|---|
| 2,871,985 | 2/1959 | Stutz | 187/29 |
| 3,804,209 | 4/1974 | Edison | 187/29 R |
| 4,149,614 | 4/1979 | Mandel et al. | 340/19 R X |

*Primary Examiner*—James D. Thomas
*Assistant Examiner*—Thomas M. Heckler
*Attorney, Agent, or Firm*—Werner W. Kleeman

[57] ABSTRACT

An apparatus for placing in order the servicing sequence of storey calls of an elevator system, comprising storage elements for storing the storey calls, storage transmitter means for controlling the storage elements, a scanner for scanning the storage elements, and a respective further storage element operatively associated with each storey being serviced. Each such further storage element has a first input connected with the related storage element serving to store a storey call and its output is connected by means of a logic circuit with a blocking device blocking infed and stored storey calls during a servicing period corresponding to at least one revolution of the scanner. A second input of each such further storage element is connected with the output of a release device freeing the blocked storey calls after completion of a servicing period in order to accomplish storey servicing during the following servicing period. A first input of the release device is connected with an output of the scanner delivering information at the start of a scanner revolution and its second input with the output of the blocking device and with a switching device controlling the scanner drive. Release of the stored storey calls and thus initiation of a new servicing period first is accomplished when there appears at the output of the blocking device information signaling the completion of the storey calls released during the preceding servicing period.

3 Claims, 4 Drawing Figures

3
1
4
T7
S7
T6
S6
2
S3
T2
S2
T1
S1
GEPI-7
GEPI-6
GEPI-2
GEPI-1
SP7
AK7
SK7
DE7
SP6
AK6
SK6
DE6
SP2
AK2
SK2
DE2
SP1
AK1
SK1
DE1
K1
K7
RA-U
SPEPI-A
BEPI-Z
GRAPI
BEXPI1
SPEPI-Z

APPARATUS FOR PLACING IN ORDER THE SERVICING SEQUENCE OF STOREY CALLS OF ELEVATOR SYSTEMS

BACKGROUND OF THE INVENTION

The present invention relates to a new and improved construction of apparatus for arranging or placing in order the servicing sequence of storey calls of elevator systems containing storage elements for storing the storey calls and controllable by means of storey transmitters, there being provided a scanning device or scanner for scanning or sampling the storage elements.

The purpose of such type equipment is to realize a more uniform servicing of all storey calls while striving for shorter, compensated waiting times at the various storeys of a building or other structure serviced by the elevator.

With a prior art apparatus, as taught in German Pat. No. 597,151, a so-called searcher or finder device is arranged between the storage elements storing the storey calls and the travel control of the elevator. In the presence of at least one storey call this searcher device stepwise samples the storage elements in a predetermined sequence and renders effectual the stored storey calls individually at the travel control of the elevator in accordance with the predetermined sequence. The searcher device comprises two slip contacts arranged upon a common shaft driven by a stepping mechanism. These slip contacts scan stationary contacts operatively correlated to the individual storey or landings and which are connected with contacts of the storey relays forming the storage elements. When a call is infed then the searcher device begins to rotate until, upon reaching a stored storey call, the drive of such searcher device is placed out of operation by means of a contact of the storey relay which now is deenergized. After completion of the storey call the slip contacts remain in the position which they have attained. If, however, there is stored a further call, then the searcher device again becomes operative.

A drawback of this state-of-the-art equipment resides particularly in the fact that the servicing of the storey calls is accomplished in a fixed, cyclic sequence, so that storey calls appearing at a later point in time are serviced before storey calls which have arrived earlier. Consequently, in the case of elevator installations servicing a larger number of storeys or landings of a building sometimes long and annoying waiting times are present for certain of the building storeys or landings.

SUMMARY OF THE INVENTION

Hence, it is a primary object of the present invention to provide a new and improved construction of apparatus of the previously described type which extensively eliminates the aforementioned drawbacks.

Yet a further significant object of the present invention aims at the provision of a new and improved construction of apparatus for placing in order the servicing sequence of storey calls of elevator systems in a manner affording a more uniform servicing of the storeys in accordance with the input sequence of the storey calls.

Now in order to implement these and still further objects of the invention, which will become more readily apparent as the description proceeds, the apparatus of the present development is manifested by the features that a respective further storage element is operatively associated with each storey or landing of the building. A first input of each such further storage element is connected with the related storage element serving for the storage of a storey call. The output of each such further storage element is connected, by means of an OR-element or circuit composed exclusively of diodes, with a blocking device which blocks infed and stored storey calls during a servicing stage or period corresponding to at least one revolution of the scanner. The blocking device comprises a NOR-element or circuit having two inputs. A second input of the further storage element is connected with the output of a release device which frees the blocked storey calls after completion of a servicing stage or period for servicing during the following servicing period. A first input of the release device is connected with an output of the scanner which delivers information at the start of the scanner revolution. The second input of the release device is connected with the output of the blocking device and with a switching device controlling the scanner drive. Release of the stored storey calls and thus the initiation of a new servicing stage or period is first accomplished when there appears at the output of the blocking device information signaling the completion of storey calls which have been freed during the preceding servicing period or stage.

According to a preferred embodiment the release device comprises a univibrator or one-shot multivibrator, an input of which forms the first input of the release device and is connected with the input of a NOT-element or circuit and the output of which is connected with the first input of a storage formed of two NOR-elements or circuits. The second input of the storage forms the second input of the release device and both the output of the NOT-element as well as also the output of the storage are connected at the inputs of a further NOR-element or circuit, the output of which also constitutes the output of the release device.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
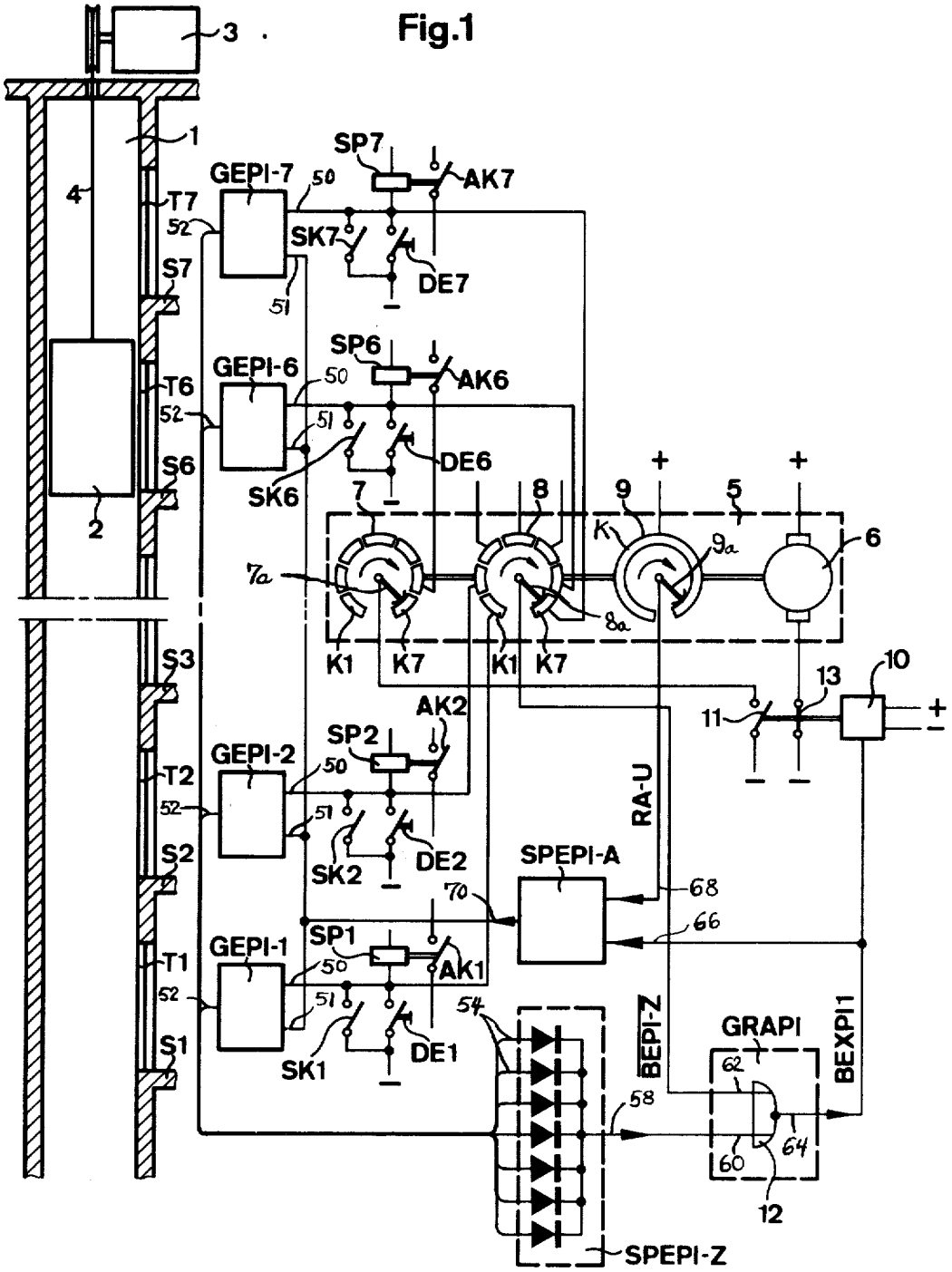
FIG. 1 is a schematic illustration of an elevator or elevator system equipped with the inventive apparatus for placing in order the servicing sequence of the storey calls.

Describing now the drawings, it is to be understood that only enough of the elevator system has been shown therein to enable those skilled in the art to readily understand the underlying principles and concepts of the present invention. Turning attention now to FIG. 1, reference character 1 designates an only partially illustrated elevator shaft within which there is guided an elevator or lift cabin 2. A standard drive or conveyor unit 3, controlled by any suitable and therefore not particularly illustrated drive control, drives the elevator cabin 2 by means of a conveyor cable 4 or equivalent structure. For purposes of discussion in the exemplary embodiment of elevator system it has been assumed that the elevator cabin 2 services seven building storeys or landings S1 to S7. Reference characters T1 to T7 designate elevator shaft or hoistway doors arranged at these storeys or landings S1 to S7, respectively. Storage elements or storages SP1 to SP7, for instance electromechanical relays, storing the storey calls, are operatively associated with the storeys S1 to S7. These storage elements SP1 to SP7 are controlled by storey transmitters or transmitter means DE1 to DE7 arranged at the storeys S1 to S7, respectively. Connected in parallel with the storey transmitters DE1 to DE7 are the self-holding contacts SK1 to SK7, respectively, by means of which it is possible to apply a potential to the relays SP1 to SP7. Reference character 5 designates a scanner or scanning device driven by a scanner drive motor 6. The scanner 5 has three switching sections 7, 8, 9. The first switching section 7 and the second switching section 8 each have seven fixed contacts K1 to K7 operatively associated with the individual storeys or landings S1 to S7 and a respective rotatable contact arm or wiper *7a* and *8a*. The third switching section 9 has only one fixed contact K extending from contact K1 to contact K7 approximately over the entire periphery as well as a rotatable contact arm or wiper *9a*. The fixed contacts K1 to K7 of the first switching section 7 are connected with work contacts AK1 to AK7 of the relays SP1 to SP7, respectively, whereas the contact arm *7a* is connected with a further work contact 11 which can be switched by a switching device or switching means 10. By means of the work contacts AK1 to AK7 there can be given travel commands, wherein for instance there can be used a travel control as disclosed in Swiss Pat. No. 357,173.

Each storey S1 to S7 has operatively associated therewith a further storage element or storage GEPI-1 to GEPI-7, respectively, which will be discussed more fully hereinafter in conjunction with the description of FIG. 2, The first input 50 of each such further storage GEPI-1 to GEPI-7 is connected with the related relay SP1 to SP7, respectively, serving for storage of a storey call and with the related respective fixed contact K1 to K7 of the second switching section 8 of the scanner 5, as particularly indicated in FIG. 1 for the storage GEPI-2. The outputs 52 of the storage elements GEPI-1 to GEPI-7 are connected with the inputs 54 of an OR-element or circuit SPEPI-Z formed exclusively of diodes 56. The output 58 of the OR-element or circuit SPEPI-Z is connected with the first input 60 of a NOR-circuit or element 12 forming a blocking device GRAPI. The second input 62 of the NOR-element 12 is connected with the contact arm *8a* of the switching section 8 of the scanner 5 and its output 64 is connected with the control circuit of the switching device 10. By means of a rest contact 13, which can be actuated by the switching device 10, it is possible to control the scanner motor or drive 6. The blocking device GRAPI is assigned the task of blocking the storey calls sampled at the contacts K1 to K7 of the switching section 8 and arriving during a servicing stage or period, the duration of such servicing stage or period coinciding with the revolving time of the mechanical scanner 5.

Figure 3:
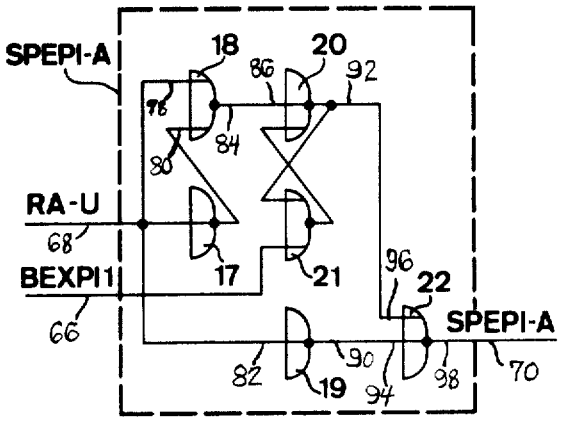
FIG. 3 is a circuit diagram of a release device.

A release device SEPI-A, to be discussed more fully in conjunction with the description of FIG. 3, is connected by means of its first input 66 with the output 64 of the NOR-element 12 of the blocking device GRAPI and by means of its second input 68 with the contact arm *9a* of the switching section 9 of the scanner 5. The output 70 of the release device SPEPI-A is connected with the respective second input 51 of the further storage elements GEPI-1 to GEPI-7. The release device SPEPI-A is assigned the task of releasing for servicing in the next servicing stage or cycle the storey calls which have been stored and blocked during a preceding servicing stage.

The characters "+" and "−" are, as usual, designations of potentials and relate to terminals of not further illustrated voltage sources, as is conventional in the electronics art.

Figure 2:
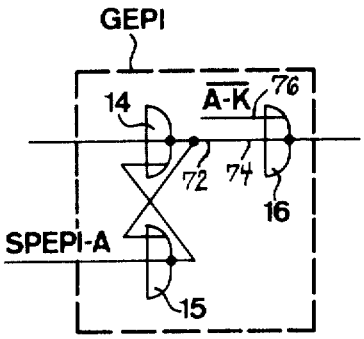
FIG. 2 is a circuit diagram of a further storage element operatively associated with each storey.

According to the showing of FIG. 2 the further storage elements GEPI-1 to GEPI-7 each consist of a storage formed in conventional manner of two NOR-elements or gates 14, 15, the output 72 of which has connected thereafter a NOR-element or gate 16 having two inputs 74 and 76. Each such storage 14, 15 is set by means of the first input 50, upon infeed of a storage call, and which first input 50 is connected with the related storage elements SP1 to SP7 and is flipped-over by means of the second input 51, upon arrival of a release pulse, the second input being connected with the release device SPEPI-A, with the result that the stored storey call is released for servicing.

In the circuit arrangement of FIG. 3 references character 17 designates a NOT-element and reference character 18 a NOR-element of a univibrator having two inputs. The input 68 of the univibrator 17, 18 is connected with the input 82 of a NOT-element 19 as well as with the contact arm *9a* of the switching section 9 of the scanner 5. Its output 84 is connected with the first input 86 of a storage formed in known manner from two NOR-elements 20, 21. The second input 88 of the storage 20, 21 is connected with the output 64 of the blocking device GRAPI. The respective outputs 90 and 92 of the NOT-element 19 and the storage 20, 21 are connected with both respective inputs 94 and 96 of a NOR-element or gate 22, the output 98 of which is connected with the second input 51 of the further storages GEPI-1 to GEPI-7.

Figure 4:
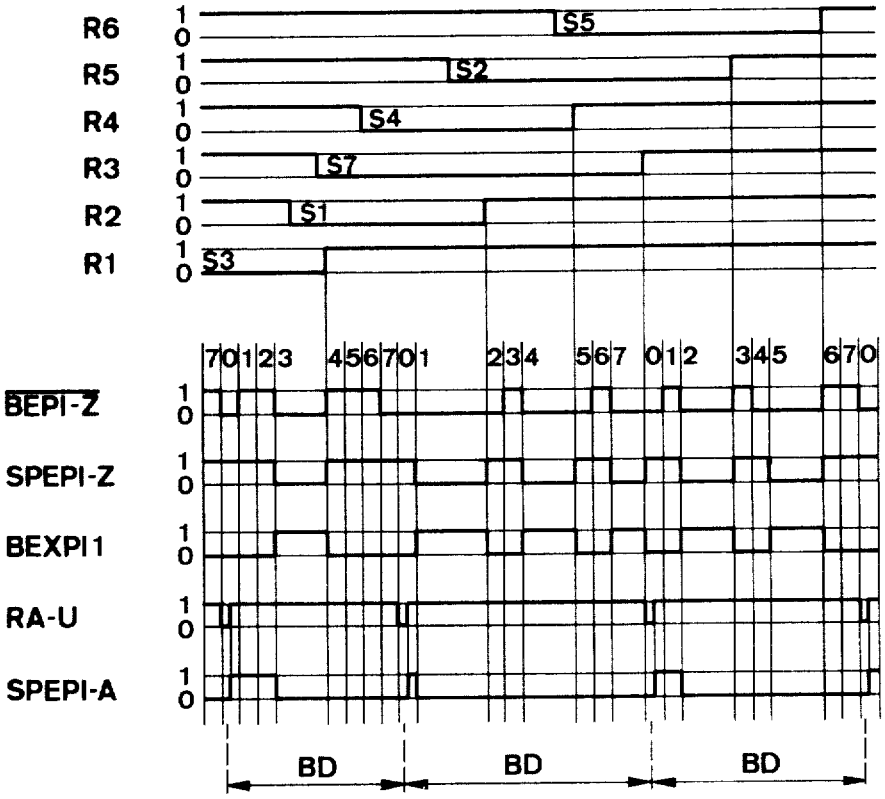
FIG. 4 is a pulse diagram or graph when using a mechanical scanner.

At this point reference is made to FIG. 4 wherein it is to be understood that the following reference characters have the following meanings:

R1 to R6
Storey calls which arrive in succession as a function of time in the sequence of the numbering;

$\overline{\text{BEPI-Z}}$
The information delivered by the switching section 8 of the scanner 5;

SPEPI-Z
The information appearing at the output of the OR-element SPEPI-Z;

BEXPI1
The information appearing at the output of the blocking device GRAPI;

RA-U
The information delivered by the switching section 9 of the scanner 5;

SPEPI-A
The information appearing at the output of the release device SPEPI-A; and BD
The duration of a servicing stage or period.

The prevailing information, as is conventional for the designation of logical states in digital circuits, can assume the logical states or values "1" and "0". In the subsequent functional description there thus likewise will be employed the designations of logical signal "1" and logical signal "0", and equally by such representations there can be understood a state of potential and no potential as is conventional. A small time scale has been chosen for the representation of the time duration of the information during standstill of the scanner 5 upon servicing of a storey call. Having now had the benefit of the previous discussion of the apparatus of the invention its mode of operation will be considered and is as follows:

It is assumed that a call R1 has been infed for the third storey or landing S3 of the building, whereupon the scanner 5, whose contact arms *7a*, *8a*, *9a* may be located in the position K7, begin to rotate in the direction of the arrows. Since there is not stored any call for the storey S7 and the control current circuit of the storage elements SP1 to SP7 are designed such that with open self-holding contacts SK1 to SK7 there is present the logical state "1" at its connections or terminals which are connected with the contacts K1 to K7 of the switching section 8, at this moment of time there prevails the information $\overline{\text{BEPI-Z}}=1$ (FIG. 4) and the first input 50 of the further storage element GEPI-7 connected with the storage element SP7 has appearing thereat the logic signal "1", and the output 72 of the related storage 14, 15 carries the logic signal "0". The information at the output 52 of the subsequently connected NOR-element 16 appears as a logic signal "1", since at its second input 76 there appears the information $\overline{\text{A-K}}=0$. The information $\overline{\text{A-K}}$ always then assumes the logic state "0", whenever the relevant storey or landing is scanned. Consequently, the output 58 of the OR-element SPEPI-Z carries the information SPEPI-Z=1 and at the output 64 of the blocking device GRAPI there appears the information BEXPI1=0 (FIG. 4).

At the same point in time the information appearing at the input 68 of the univibrators 17, 18 of the release device SPEPI-A appears as RA-U=1. With BEXPI1=0 or 1 there is present at the output 92 of the storage 20, 21 and at the first input 96 of the NOR-element 22 of the release device SPEPI-A the logical signal "1". With the logic signal "0" at the output 90 of the NOT-element 19 and at the second input 94 of the NOR-element 22 there is present at its output 98 (output 70 of the release device SPEPI-A) which is connected with the further storage elements GEPI-1 to GEPI-7 the information SPEPI-A=0. Upon transition of the contact arm *9a* of the switching section 9 from the position K7 to the position K1 there appears the information RA-U=0 (FIG. 4). Thereafter there appears at the output 84 of the univibrator 17, 18 a short logic signal "1" and the output 92 of the storage 20, 21 switches to the logic state "0". If at this point in time there prevails the information BEXPI1=1, then the output 92 of the storage 21, 22 again would carry the logic signal "1", after disappearance of the aforesaid brief or short logic signal "1" at the output 84 of the univibrator 17, 18. Since however BEXPI1=0, the output 92 of the storage 20, 21 remains in the logic state "0". Now if during the following servicing state or period BD there prevails the information RA-U=1, then there appears at the output 90 of the NOT-element 19 and at the second input 94 of the NOR-element 22 the logic signal "0", so that there is assumed a state where the information SPEPI-A=1, which information appears at its output 70 (FIG. 4). Thus, the storage 14, 15 of the further storage element GEPI-3 can switch into the logic output state "1". This means that the storey call R1 which has been stored in the preceding servicing stage BD for the storey S3 is released for servicing during the progression of the servicing stage or period BD.

During the course of the further rotation of the scanner 5 there are scanned or sampled the contacts K1 and K2. Since, however, for the storeys S1 and S2 there have not been infed and stored any calls, there occur the same procedures as already described for the storey S7. Therefore there prevail the information states $\overline{\text{BEPI-Z}}=1$, SPEPI-Z=1, BEXPI1=0 and RA-U=1. However, the information, SPEPI-A further remains in the logic state "1" (FIG. 4). Upon reaching the contact K3 there prevails BEPI-Z=0. Since the output of the storage 14, 15 of the further storage element GEPI-3 now carries the logic signal "1" and there exists the information $\overline{\text{A-K}}=0$, there thus prevails the state for the output of the further storage GEPI-3 and the information SPEPI-Z=0. Thus, BEXPI1=1 and SPEPI-A=0, which however does not change the output state of the storage 14, 15. With BEXPI1=1 the switching device 10 is controlled and the drive motor 6 is turned-off by means of the rest contact 13, whereby the scanner 5 comes to standstill. At the same time the work contact 11 closes, so that by means of the contact K3 of the switching section 7 and the work contact AK3 a travel command can be given and the elevator cabin 2 travels to the storey S3 in accordance with the infed storey call R1. Upon completion of the call the current circuit of the storage element SP3 is interrupted, whereupon the work contact AK3 opens and the elevator cabin 2 stops. Since at this moment the output state of the storage 14, 15 of the further storage element GEPI-3 switches from the logic state "1" to the logic state "0", there also prevails BEXPI1=0, and the work contact 11 opens and the rest contact 13 closes.

If there is not stored any further storey call, then the scanner 5 remains in the position K3. However, it is assumed that during the servicing of the storey call R1 and the subsequent servicing time of a cabin call which has not been illustrated in FIG. 4, further storey calls R2 and R3 are infed and stored for the storeys S1 and S7. In this case the scanner 5 again begins to rotate. Upon scanning the contacts K4, K5, and K6, at which there have not been stored any storey calls in the preceding servicing state of cycle BD, there occur the same procedures as previously described. Shortly prior to reaching the contact K7 it is possible for a further storey call R4 to have been infed for the storey S4. Upon reaching the contact K7 the information appears as $\overline{\text{BEPI-Z}}=0$, SPEPI-Z=1 and thus BEXPI1=0, which means, that the call R3 which has been stored for the storey S7 is not serviced during the servicing stage or cycle BD which is in progress.

Upon transition from the position K7 to the position K1 then, as previously described, there are released the storey calls R2, R3, R4 which have been stored and blocked in the preceding servicing stage BD, so that they can be serviced, during the next following servicing stage BD, in the sequence governed by the scanner 5. Further incoming storey calls, for instance R5, R6 for the storeys S2, S5 are again first serviced in the next servicing stage BD and so forth.

The advantages which are realized with the invention reside in the fact that the servicing of the storage calls can be better accommodated to the time sequence of the call inputs. Thus, in the previously described example, as apparent from the pulse sequence BEXPI1 (FIG. 4), the calls are serviced in the sequence R1-R2-R4-R3-R-5-R6, whereas in the case of a purely mechanical apparatus the calls are serviced in the sequence R1-R3-R-2-R5-R4-R6. The attained improvements will become even more readily evident if in the preceding example there are interchanged the calls R3 and R4 and the point in time of input of the storey call R3 (storey S4) is shifted to a time point shortly after the scanning of the contact K4. Hence, with the inventive apparatus there is realized a sequence R1-R2-R3-R4-R5-R6 which corresponds exactly to the time sequence of the inputs while with purely mechanical scanners the sequence is R1-R4-R2-R5-R3-R6.

Instead of the mechanical scanner 5 which has been illustrated and described in conjunction with the exemplary embodiment, it is also possible to use an electronic scanner which, in contrast to the mechanical scanner 5, continuously revolves at an appreciably greater speed. As a result, there is realized an appreciably greater scanning time for each storey or landing of the building and the scanner, upon servicing a storey call, no longer comes to standstill. The servicing stages or periods BD here correspond to a multiple of a scanner revolution; a servicing stage BD begins with the generation of the release information SPEPI-A=1. This is produced when no information BEXPI1=1 appears between two successive bits of information RA-U=1. The information RA-U=1 is produced in each case upon scanning the first storey S1 in the UP-direction of the scanner.

While there are shown and described present preferred embodiments of the invention, it is to be distinctly understood that the invention is not limited thereto, but may be otherwise variously embodied and practiced within the scope of the following claims. Accordingly,

What we claim is:

1. An apparatus for placing in order the servicing sequence of storey calls of an elevator system comprising:

storage elements for storing the storey calls;

storey transmitter means for controlling said storage elements;

a revolving scanner device for scanning the storage elements, at least one revolution of said scanner corresponding to a servicing period;

a drive for driving said scanner device;

a respective further storage element operatively associated with each storey being serviced;

each said further storage element having a first input, a second input and an output;

said first input being connected with the related storage element serving for storing a storey call;

an OR-circuit having an output composed exclusively of diodes;

a blocking device for blocking the infed and stored storey calls during at least one servicing period corresponding to a revolution of the scanner device;

said output of each further storage element being connected by means of said OR-circuit with said blocking device;

said blocking device comprising a NOR-circuit having two inputs, one of said inputs being connected to the output of said OR-circuit, the other of said inputs being connected by means of said scanner device to the first input of said further storage element, and an output;

a release device freeing the blocked storage calls after completion of a servicing period for storey servicing during the following servicing period;

said release device having a first input, a second input and an output;

said second input of each said further storage element being connected with said output of said release device;

said first input of said release device being connected with an output of the scanner device delivering information at the start of the revolution of the scanning device;

a switching device controlling said drive of said scanning device;

the second input of the release device being connected with the output of the blocking device and with the switching device;

the release of the stored storey calls and thus the initiation of a new servicing period only then being accomplished if there appears at the output of the blocking device information signaling the completion of the storey calls freed in the preceding servicing period.

2. The apparatus as defined in claim 1, wherein: said release device comprises:

an univibrator having an input forming said first input of the release device;

a NOT-element having an input and an output;

said first of said release device being connected with the input of the NOT-element;

said univibrator having an output;

a storage composed of two NOR-elements and having a first input and a second input and an output;

the output of the univibrator being connected with the first input of said storage;

the second input of the storage constituting the second input of the release device;

a further NOR-element having inputs and an output;

the output of the NOT-element and the output of the storage being connected with the inputs of said further NOR-element; and the output of the further NOR-element simultaneously constituting the output of the release device.

3. An apparatus for placing in order the servicing sequence of storey calls of an elevator system, comprising:

a respective storage element for each storey for storing the storey calls;

storey transmitter means for controlling said storage elements;

a scanner for scanning the storage elements, at least one revolution of said scanner corresponding to a servicing period;

a drive for cycling the scanner;

a respective further storage element operatively associated with each storey being serviced;

each said further storage element having a first input, a second input and an output;

said first input being connected with the related storage element of its storey serving for storing a storey call;

an OR-circuit composed exclusively of diodes;

a blocking device for blocking the infed and stored storey calls during at least one servicing period corresponding to one cycle of the scanner;

said output of each further storage element being connected by means of said OR-circuit with said blocking device;

said blocking device comprising a NOR-circuit having two inputs, one of said inputs being connected to the output of said OR-circuit, the other of said inputs being connected by means of said scanner device to the first input of said further storage element, and an output;

a release device freeing the blocked storage calls after completion of a servicing period for storey servicing during the following servicing stage;

said release device having a first input, a second input and an output;

said second input of each said further storage element being connected with said output of said release device;

said first input of said release device being connected with an output of the scanner delivering information at the start of cycling of the scanner;

a switching device controlling said drive of said scanner;

the second input of the release device being connected with the output of the blocking device and with the switching device;

the release of the stored storage calls and initiation of a new servicing period then being accomplished only when there appears at the output of the blocking device information signaling the completion of the storey calls freed in the preceding servicing period.

* * * * *